US010224139B2

(12) United States Patent
Kanazawa et al.

(10) Patent No.: US 10,224,139 B2
(45) Date of Patent: Mar. 5, 2019

(54) COIL DEVICE

(71) Applicant: FDK CORPORATION, Tokyo (JP)

(72) Inventors: Yuko Kanazawa, Tokyo (JP); Masaru Shinoda, Tokyo (JP); Kiyoto Ono, Tokyo (JP); Tetsu Yamanaka, Tokyo (JP); Mikio Kitaoka, Tokyo (JP)

(73) Assignee: FDK Corporation, Tokyo (JP)

( * ) Notice: Subject to any disclaimer, the term of this patent is extended or adjusted under 35 U.S.C. 154(b) by 0 days.

(21) Appl. No.: 15/514,747

(22) PCT Filed: Sep. 18, 2015

(86) PCT No.: PCT/JP2015/076634

§ 371 (c)(1),
(2) Date: Mar. 27, 2017

(87) PCT Pub. No.: WO2016/052251

PCT Pub. Date: Apr. 7, 2016

(65) Prior Publication Data

US 2017/0243688 A1 Aug. 24, 2017

(30) Foreign Application Priority Data

Oct. 3, 2014 (JP) ..... 2014-204570

(51) Int. Cl.
*H01F 27/08* (2006.01)
*H01F 27/24* (2006.01)
(Continued)

(52) U.S. Cl.
CPC ..... *H01F 27/08* (2013.01); *H01F 3/14* (2013.01); *H01F 27/22* (2013.01); *H01F 27/24* (2013.01);
(Continued)

(58) Field of Classification Search
USPC ..... 336/61, 55, 57, 59, 60
See application file for complete search history.

(56) References Cited

U.S. PATENT DOCUMENTS 6,392,519 B1 * 5/2002 Ronning ..... H01F 27/025 336/61
2002/0067237 A1 * 6/2002 Nakata ..... H01F 27/29 336/212
(Continued)

FOREIGN PATENT DOCUMENTS

JP 2005-064318 A 3/2005
JP 2009-206308 9/2009
(Continued)

OTHER PUBLICATIONS

Int'l Search Report issued in Int'l. App. No. PCT/JP2015/076634, dated Dec. 15, 2015.
(Continued)

*Primary Examiner* — Elvin G Enad
*Assistant Examiner* — Kazi Hossain
(74) *Attorney, Agent, or Firm* — Greer Burns & Crain Ltd.

(57) ABSTRACT

A coil device includes two core members, one of which is E-shaped. The E-shaped core member has left and right side faces, and a center leg that extends in a vertical direction. A conducting wire is wound around a core, the core being composed of the two core members arranged to face each other in the vertical direction with a gap between the two core members. The conducting wire is wound around the center leg. First and second heat-sinking plates made of metal are bent so as to be in contact with upper and side faces of the core. The first and second plates are arranged so that first edges of the plates are placed left-right symmetrically with respect to the core with a gap between the edges.
(Continued)

Second edges of the plates are in contact with a metal heat-sinking board where the core is placed.

3 Claims, 10 Drawing Sheets

(51) Int. Cl.

| | |
|---|---|
| ***H01F 27/28*** | (2006.01) |
| ***H01F 3/14*** | (2006.01) |
| ***H01F 27/22*** | (2006.01) |
| ***H01F 27/26*** | (2006.01) |
| *H01F 27/29* | (2006.01) |

(52) U.S. Cl.
CPC ..... *H01F 27/26* (2013.01); *H01F 27/2823* (2013.01); *H01F 27/2876* (2013.01); *H01F 27/292* (2013.01)

(56) References Cited

U.S. PATENT DOCUMENTS

| | | | | |
|---|---|---|---|---|
| 2010/0207714 | A1 | 8/2010 | Lai et al. | |
| 2012/0013427 | A1 | 1/2012 | Noda et al. | |
| 2012/0169443 | A1 | 7/2012 | Takiguchi et al. | |
| 2013/0265129 | A1* | 10/2013 | Ansari | H01F 27/22 336/61 |
| 2015/0042432 | A1* | 2/2015 | Delalandre | H01F 27/22 336/61 |
| 2015/0170819 | A1* | 6/2015 | Yamashima | H01F 37/00 336/61 |
| 2016/0307684 | A1 | 10/2016 | Takiguchi et al. | |

FOREIGN PATENT DOCUMENTS

| | | | |
|---|---|---|---|
| TW | 201030778 | A1 | 8/2010 |
| TW | 201101346 | A | 1/2011 |
| WO | WO 2011/030531 | A1 | 3/2011 |
| WO | WO 2015/111404 | A1 | 7/2015 |

OTHER PUBLICATIONS

Taiwan Search Report issued in corresponding Taiwanese Patent App. No. 104132403, dated Jul. 4, 2018.
Taiwan Office Action issued in corresponding Taiwanese Patent App. No. 104132403, dated Jul. 9, 2018 (with translation).

* cited by examiner

COIL DEVICE

This is a National Phase Application filed under 35 U.S.C. § 371, of International Application No. PCT/JP2015/076634, filed Sep. 18,2015.

TECHNICAL FIELD

The present invention relates to a coil device provided with a coil component such as a choke coil or a transformer. Specifically, the present invention relates to a heat dissipation technology in a coil device.

BACKGROUND ART

FIGS. 1A and 1B illustrate a basic structure of a coil device 1. FIG. 1A is a perspective view illustrating the coil device 1. FIG. 1B is a cross-sectional view of FIG. 1A in the direction of view arrows a-a. That is, when a winding axis of the coil 4 is arranged in the vertical direction, if "front", "rear", "left" and "right" are defined as illustrated in FIG. 1A, FIG. 1B is a diagram of a cross-section of the coil device 1, as viewed from arrows a-a of FIG. 1A, extending in the vertical direction and the left-right direction. The coil device 1 includes an electronic component (hereinafter, also referred to as a coil component 10) such as a transformer, the transformer including: a well-known EE-shaped core 2, which has left and right side faces and in which two core members 2*u* and 2*d* having an E-shape as seen from front are arranged opposite in the vertical direction; and a coil 4 formed by winding conducting wires around a center leg 3 of the core 2. In addition, the lower face 11 of the core 2 is in contact with a heat-sinking board 5. As a result, heat generated by electrically conducting the coil 4 is guided to the heat-sinking board 5 through the core 2 so as to cool the coil component 10.

As for an electronic module such as a DC-to-DC converter composed of the coil device 1, miniaturization and increase of output are demanded. And, the increase of output of the coil device 1 directly leads increase of output of the electronic module. In addition, miniaturization of the coil device 1, whose footprint is larger than other electronic components, significantly contributes to miniaturization of the electronic module. However, miniaturization and increasing output of the coil device 1 makes it difficult to effectively dissipate the heat generated from the coil 4.

Specifically, the increase of output of the coil device 1 may be achieved by increasing an electric current flowing through the coil 4. However, if a large current exceeding a saturation magnetic flux density of the core 2 flows through the coil 4, a switching element used to drive the coil device 1 maybe broken down. In this regard, a gap for preventing a magnetic saturation (gap 20 in FIGS. 1A and 1B) is provided in the core 2 of the coil device 1. However, seeking the increase of output means requiring to obtain a large magnetic flux density by flowing a large current to a winding of the coil 4. This increases heat generated by the coil device 1 of higher output. In addition, the gap 20 which is an air layer having a low heat conductivity is indispensable for the increase of output of the coil device 1. For this reason, it is difficult to achieve both the increase of output and the improvement of heat dissipation efficiency in the coil device 1. In particular, the upper core member 2*u* is not in direct contact with the heat-sinking board 5, and the member 2*u* is not easily cooled down because a path to the heat-sinking board 5 from the center leg 3 around which the coil 4 serving as a heat source is wound is substantially split. Furthermore, the miniaturization of the coil device 1 reduces a contact area with the heat-sinking board 5. This makes more difficult to dissipate the heat. Naturally, the miniaturization of the coil device 1 decreases a heat generated in the core 2, and this makes it easier to increase a temperature under the same amount of heat. In addition, since the miniaturization of the coil device 1 decreases a surface area of the core 2 that exposes the atmosphere or a surface area that radiates the heat to the atmosphere, it is difficult to effectively discharge heat to the atmosphere. If the heat dissipation is insufficient, the coil device 1 may suffer from thermal runaway, and the coil device 1 may lost its function. Moreover, for the miniaturization of electronic modules, it is necessary to mounted the electronic components densely around the coil device 1, and this may cause thermal breakdown of electronic components around the coil device 1. Naturally, a cooler (such as a fan) for suppressing a rise of the temperature inevitably increases the size of the electronic module.

In this regard, a technique has been proposed in Patent Literature 1.

CITATION LIST

Patent Literature

[Patent Literature 1] Japanese Unexamined Patent Application Publication No. 2009-206308

SUMMARY OF INVENTION

Technical Problem

A transformer attaching apparatus discussed in Patent Literature 1 includes: a transformer, a heat-sinking sheet, and a transformer attaching member: the transformer is mounted on a flat heat sink formed of metal, the heat-sinking sheet is placed on an upper face of a core of the transformer, and the transformer attaching member fixes the heat-sinking sheet and guides the heat generated from an upper part of the transformer to a heat sink. The transformer attaching member includes: a ceiling that presses the heat-sinking sheet from above; and an installation arm which is connected to the ceiling and which bents and droops downward along a side face of the core. Furthermore, on a distal end of the installation arm, is provided an installation portion which bents perpendicularly outward so as to face the heat sink. The installation portion is fixed to the heat sink (heat-sinking board) by a screw.

However, in the transformer attaching apparatus discussed in Patent Literature 1, the heat of the upper face of the core is guided to the heat sink through the heat-sinking sheet connected to the upper face and through the transformer attaching member connected to the heat-sinking sheet. Therefore, thermal conduction efficiency is low, and, in the coil device of higher output, heat dissipation effect is limited. In addition, in order to prevent recovery of the heat-sinking sheet in a thickness direction due to its elasticity, the transformer attaching member is necessary to press the heat-sinking sheet toward the upper face of the core. Therefore, the lower end of the transformer attaching member is fixed to the heat sink by screws. Therefore, if the footprint is limited, it is difficult to mount the transformer attaching apparatus on the board.

In view of the aforementioned problems, it is therefore an object of the present invention to provide a coil device capable of effectively dissipating heat without increasing its footprint.

Solution to Problem

According to an aspect of the present invention, there is provided a coil device including:

two core members, at least either one of the two core members being an E-shaped core member, the E-shaped core member having left and right side faces, the E-shaped core member having a center leg that extends in a vertical direction;

a conducting wire that is wound around a core, the core being composed of the two core members that are arranged to face each other in the vertical direction with a gap between the two core members, the conducting wire being wound around the center leg; and first and second heat-sinking plates that are composed of metal plates, the first and second heat-sinking plates being bent so as to be in contact with upper and side faces of the core, the first and second heat-sinking plates being arranged so that one edges of the first and second heat-sinking plates are placed left-right symmetrically with respect to the core with a gap between the edges, the first and second heat-sinking plates being formed so that another edges of the first and second heat-sinking plates are in contact with a metal heat-sinking board where the core is placed.

It is preferable that the core is an EI-shaped core including: the E-shaped core member being the core member arranged in a lower side; and an I-shaped core member being the core member arranged in an upper side. The coil device may further include means for maintaining constant the space between the first and second heat-sinking plates. In addition, in the coil device, a ratio $\Delta w/W$ of the space $\Delta w$ between the two heat-sinking plates to a width W of the core in a left-right direction is 0.3 or smaller.

Using the coil device according to the present invention, it is possible to effectively dissipate heat without increasing its footprint. Note that other effects would become more apparent by reading the following description.

DESCRIPTION OF EMBODIMENTS

Cross-Reference to Related Applications

Figure 1A:
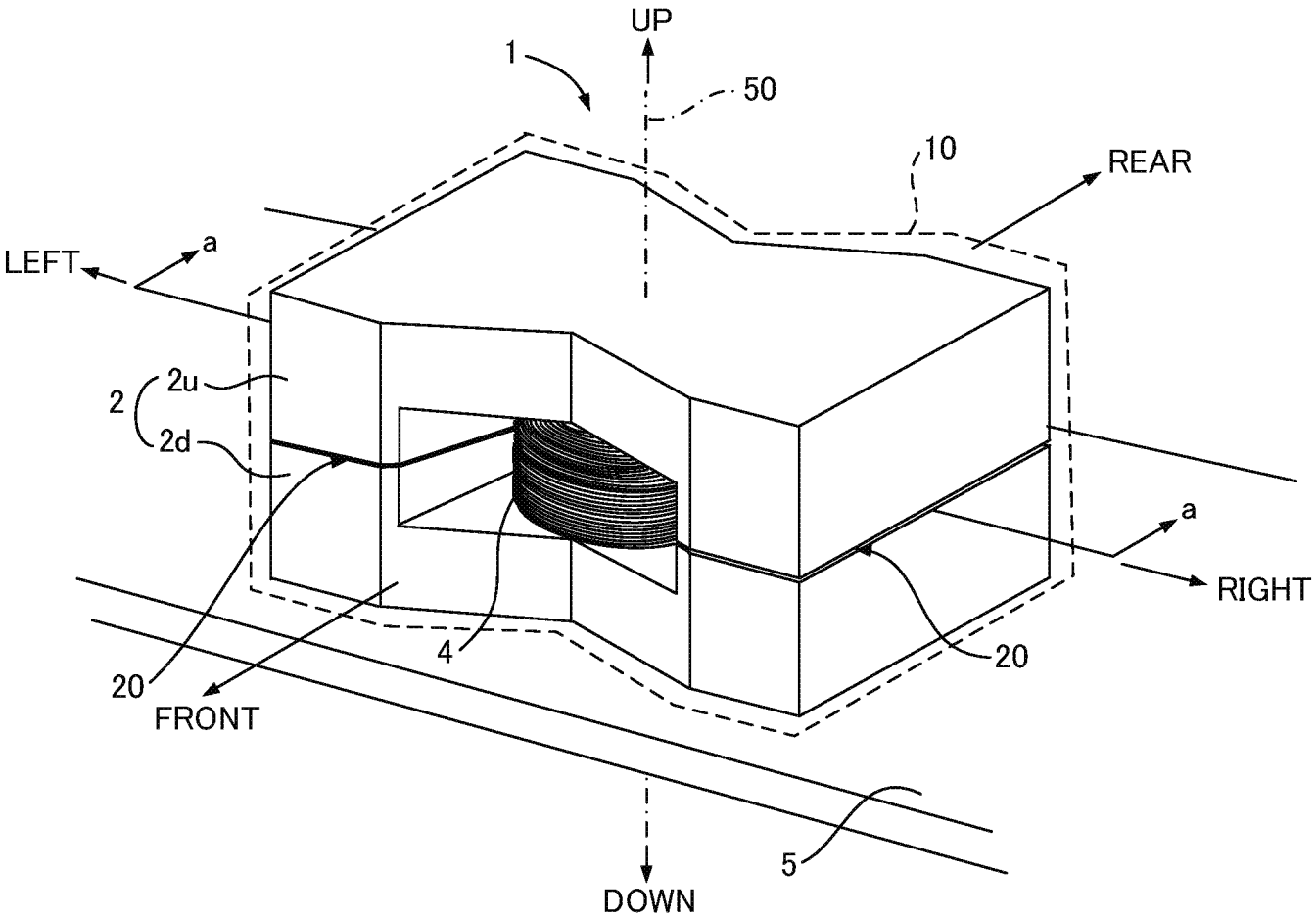
FIG. 1A is a diagram illustrating an exemplary coil device.

This application is based upon and claims the benefit of priority of the prior Japanese Patent Application No. 2014-204570, filed on Oct. 3, 2014, the entire contents of which are incorporated herein by reference.

Embodiments of the present invention will now be described with reference to the accompanying drawings. Note that, in the following description, like reference numerals denote like elements, and they will not be described repeatedly. Depending on drawings, some reference numerals may be omitted for simplicity purposes.

First Embodiment

A coil device according to an embodiment of the present invention includes a coil component such as a transformer which is configured to come into contact with a heat-sinking board. And, for example, the coil device is mounted on a circuit board of an electronic module (e.g. a DC-to-DC converter). Naturally, the heat-sinking board may be integrated into the circuit board. In any case, the core of the coil component is in contact with the heat-sinking board.

Structure

Figure 1B:
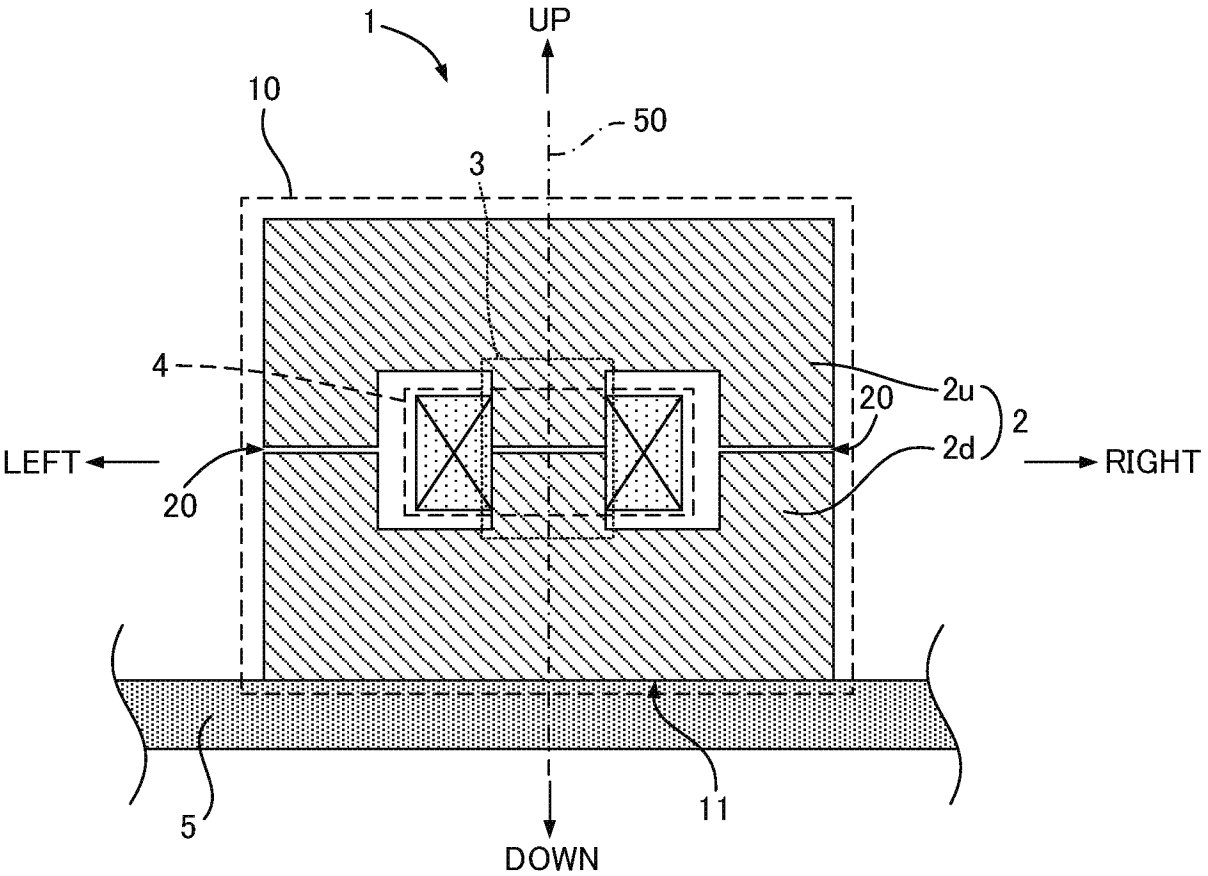
FIG. 1B is a diagram illustrating the exemplary coil device.
Figure 2A:
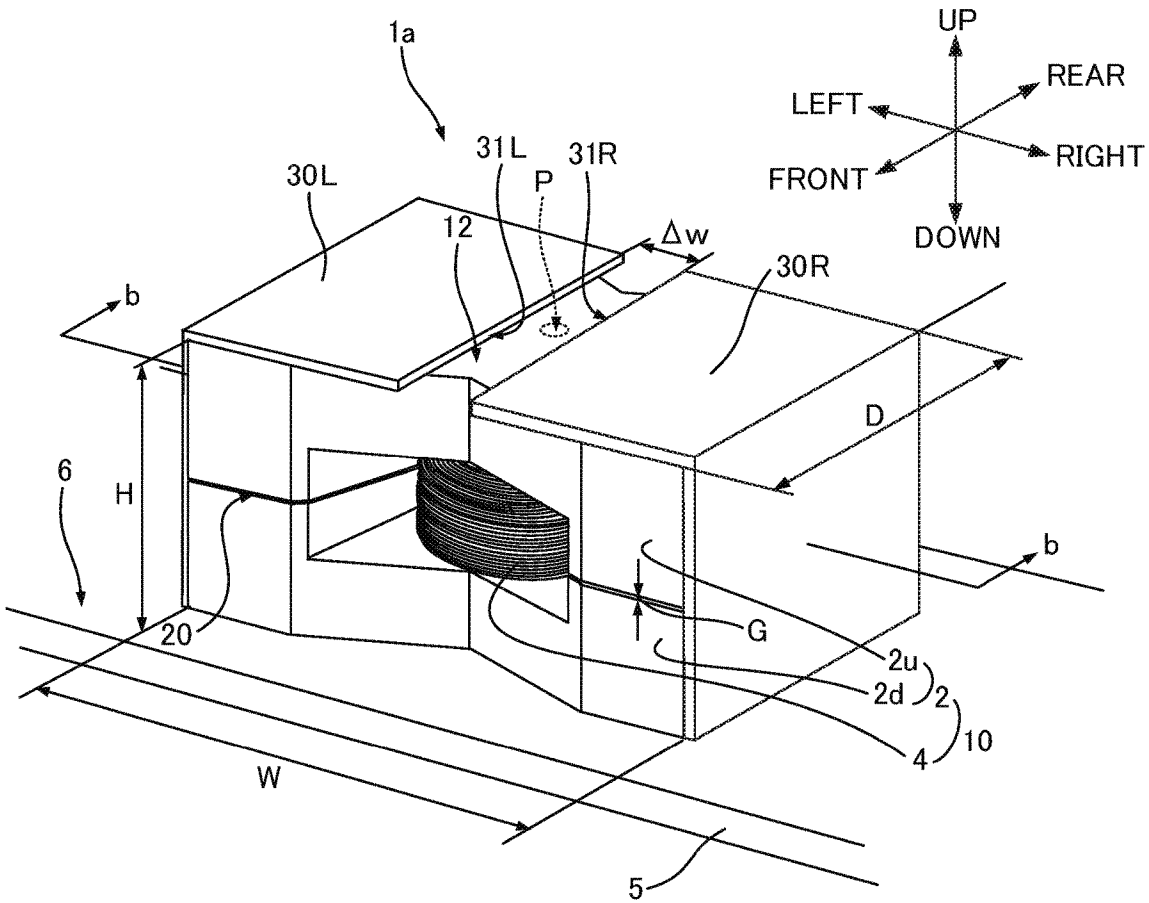
FIG. 2A is a diagram illustrating a coil device according to the first embodiment.
Figure 2B:
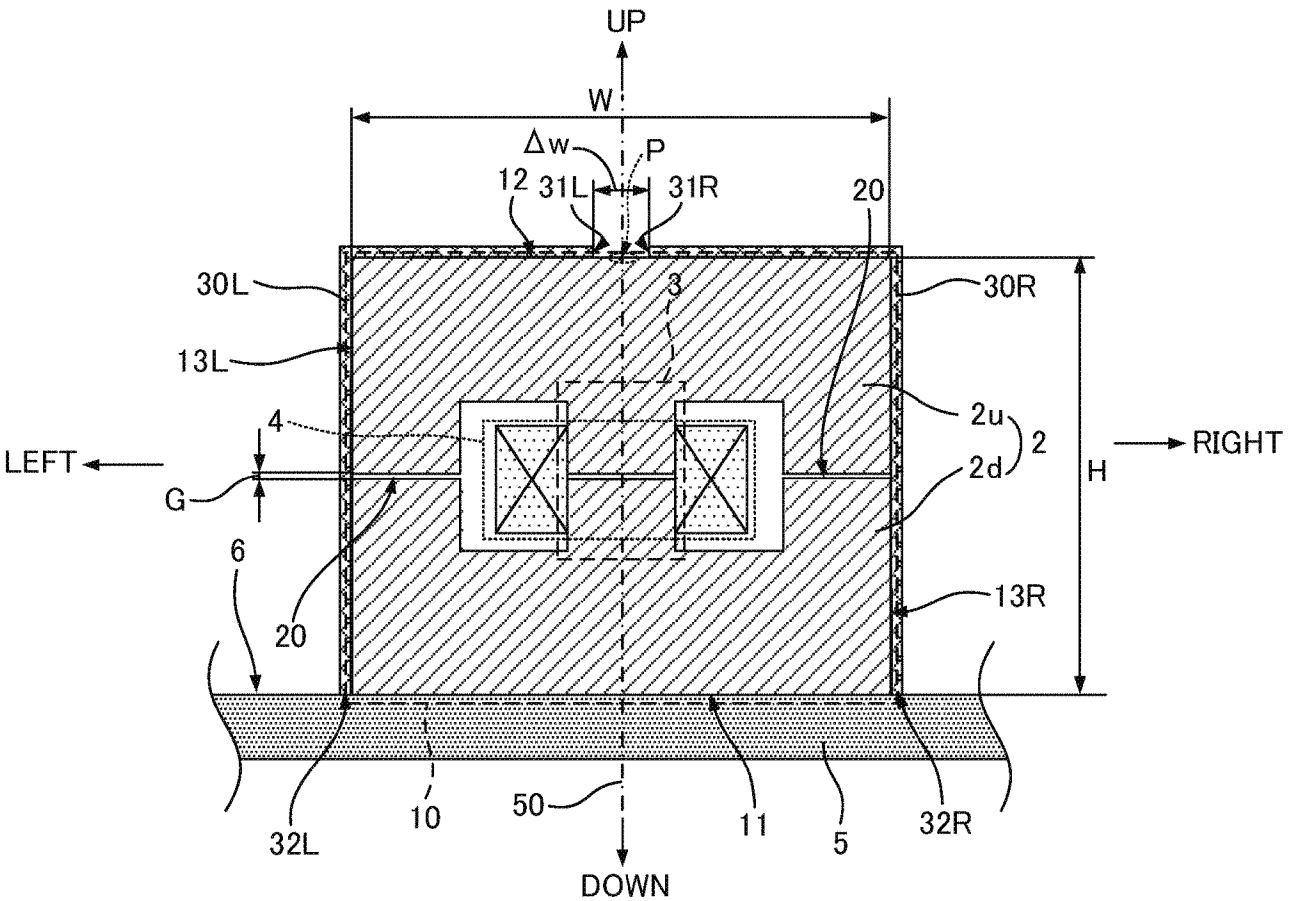
FIG. 2B is a diagram illustrating the coil device according to the first embodiment.

FIGS. 2A and 2B are diagrams illustrating a coil device 1*a* according to a first embodiment of the invention. FIG. 2A is a perspective view illustrating the coil device 1*a*. FIG. 2B is a cross-sectional view of FIG. 2A in the direction of view arrows b-b. Here, "up", "down", "left", "right" "front" and "rear" are defined as illustrated in FIG. 2A. And, similar to the coil device 1 of FIGS. 1A and 1B, the coil device 1*a* includes a coil component 10 in which the coil 4 is wound around a center leg 3 of the EE-shaped core 2. The coil device 1*a* is placed on the heat-sinking board 5 and is in contact with the heat-sinking board 5. The coil device 1*a* has a structure (a heat-sinking part 30) which is for effectively guiding the heat of the upper face 12 of the core 2 to the heat-sinking board 5 of the lower face 11 or for effectively discharging the heat to the atmosphere. Specifically, the coil device 1*a* has two heat-sinking plates 30L and 30R as the heat-sinking part 30.

The heat-sinking part 30 of FIGS. 2A and 2B includes two metal heat-sinking plates 30L and 30R formed by bending a flat metal plate in an L-shape. Hereinafter, the heat-sinking plate 30L may also be referred to as an L-shaped heat-sinking plate 30L, and the heat-sinking plate 30R may also be referred to as an L-shaped heat-sinking plate 30R. The width of each of the L-shaped heat-sinking plates 30L and 30R in the front-rear direction matches the length of the core 2 in the front-rear direction (hereinafter, referred to as a depth D).

The L-shaped heat-sinking plate 30L is mounted to the core 2 so that the plate 30L is in contact with the upper face 12 and the left face 13L of the core 2. The L-shaped heat-sinking plate 30R is mounted to the core 2 so that the plate 30R is in contact with the upper face 12 and the right face 13R of the core 2. Each of the two L-shaped heat-sinking plates 30L and 30R has one end (31L and 31R), and the ends 31L and 31R face each other on the upper face 12 of the core 2.

The L-shaped heat-sinking plate 30L extends leftward from the end 31L along the upper face 12 of the core 2, and bends downward at the left end of the upper face 12. Then, the heat-sinking plate 30L extends downward along the left face 13L of the core 2, and reaches the lower end of the left face 13L. Another end 32L is in contact with the upper face 6 of the heat-sinking board 5. Similarly, the L-shaped heat-sinking plate 30R extends rightward from the end 31R along the upper face 12 of the core 2, and bends downward at the right end of the upper face 12. Then, the heat-sinking plate 30R extends downward along the right face 13R of the core 2, and reaches the lower end of the right face 13R. Another end 32R is in contact with the upper face 6 of the heat-sinking board 5.

In order to check the heat dissipation performance of the coil device 1*a* according to the first embodiment, various coil devices s1, s2, s3 and s4 illustrated in FIGS. 3A, 3B, 3C and 3D were prepared as samples. The coil devices s1, s2, s3 and s4 are different in whether or not the heat-sinking part 30 is provided and in the shapes of the heat-sinking part 30. Then, by electrically conducting the coil 4 of each of the samples s1, s2, s3 and s4, the coil component 10 was heated. The temperature of the core 2 was investigated.

Note that the sample s1 corresponds to the coil device 1, and the sample s4 corresponds to the coil device 1*a*.

Samples

The samples s1, s2, s3 and s4 are each composed of the same core 2. Here, the core 2 common to all samples s1, s2, s3 and s4 will be briefly described with reference to FIGS. 2A and 2B. The core 2 has an EE-shape as described above and is made of ferrite. The core 2 has a gap 20 of 0.2 mm (G=0.2 mm). Here, the gap 20 is formed by arranging two E-shaped core members 2*u* and 2*d* opposite in the vertical direction, and between the core members 2*u* and 2*d* a film made of polyethylene terephthalate (PET) or the like is interposed. As for the outer dimensions of the core 2, a width (W) in the left-right direction of 48.9 mm (W=48.9 mm), a depth (D) in the front-rear direction of 34.0 mm (D=34.0 mm), and a height (H) in the vertical direction of 24.4 mm (H=24.4 mm).

Figure 3A:
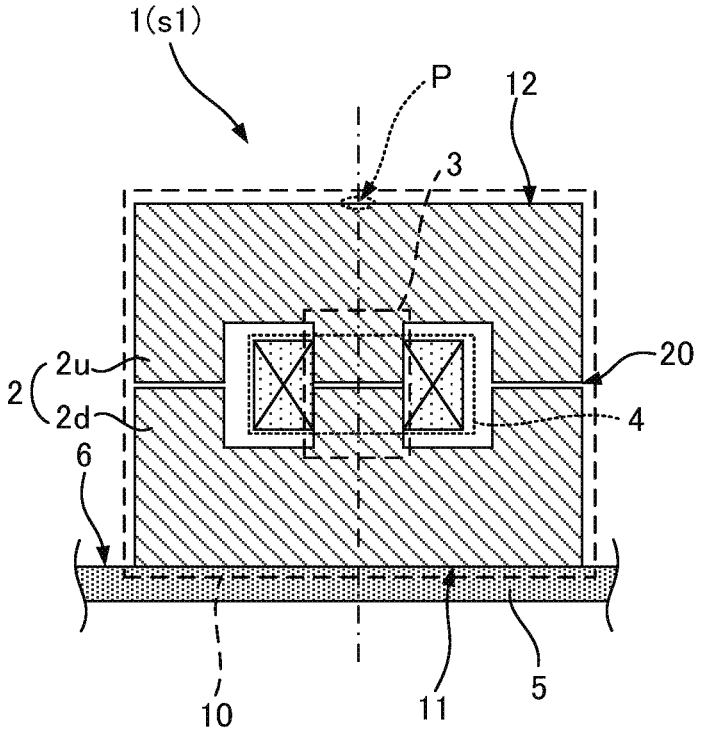
FIG. 3A is a diagram illustrating a structure of one of various coil devices which were prepared to compare and analyze a heat dissipation property of the coil device according to the first embodiment.
Figure 3B:
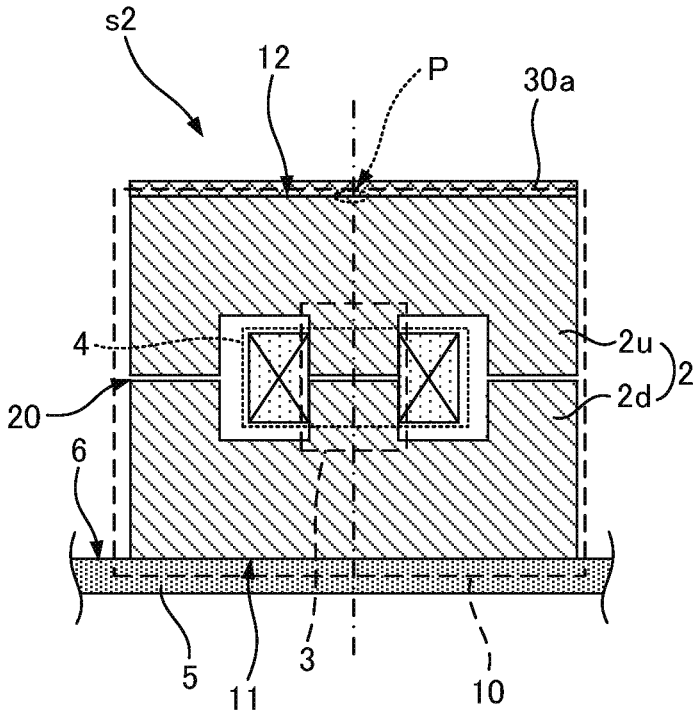
FIG. 3B is a diagram illustrating a structure of one of various coil devices which were prepared to compare and analyze a heat dissipation property of the coil device according to the first embodiment.
Figure 3C:
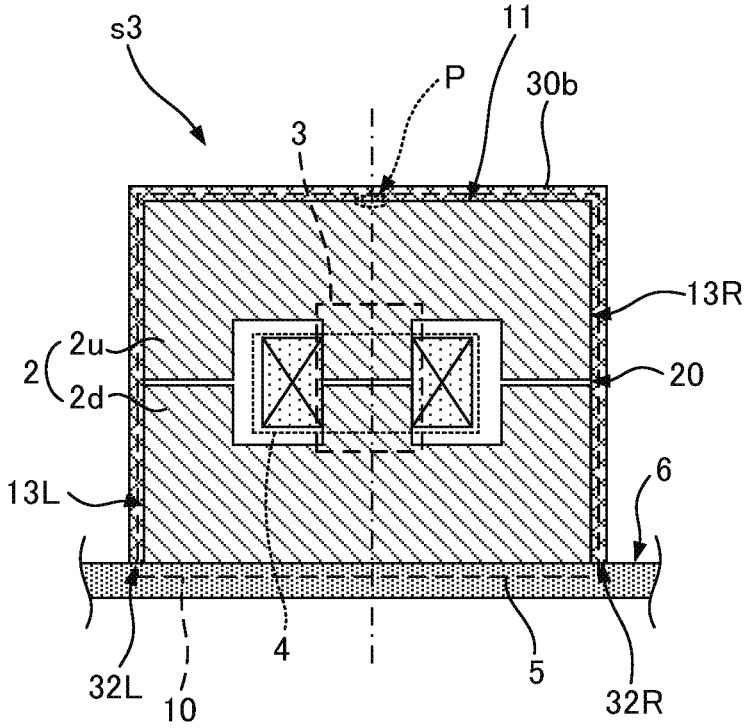
FIG. 3C is a diagram illustrating a structure of one of various coil devices which were prepared to compare and analyze a heat dissipation property of the coil device according to the first embodiment.
Figure 3D:
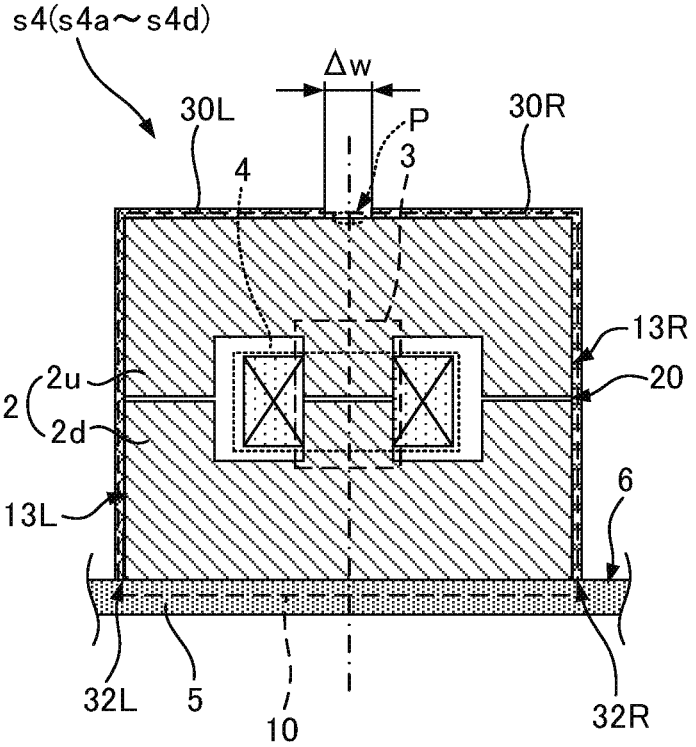
FIG. 3D is a diagram illustrating a structure of one of various coil devices which were prepared to compare and analyze a heat dissipation property of the coil device according to the first embodiment.

FIGS. 3A, 3B, 3C, and 3D are cross sectional views of FIG. 2A in the direction of view arrows b-b to illustrate structures of the samples s1, s2, s3 and s4, respectively. The prepared samples s1, s2, s3 and s4 are classified into four types depending on whether or not the heat-sinking part 30 is provided or the shapes of the heat-sinking part 30. FIG. 3A illustrates the sample s1 which does not include a heat-sinking part 30, and corresponds to the coil device 1 shown in FIGS. 1A and 1B. FIG. 3B illustrates the sample s2 in which a flat, rectangular heat-sinking plate 30*a* is arranged as the heat-sinking part 30 so as to cover the entirety of the upper face 12 of the core 2. FIG. 3C illustrates the sample s3 which includes, as the heat-sinking part 30, a C-shaped heat-sinking plate 30*b* in an integrated manner to be in contact with the upper face 12 and the side faces 13L and 13R of the core 2. And, two lower ends 32L and 32R of the heat-sinking plate 30*b* are in contact with the upper face 6 of the heat-sinking board 5. FIG. 3D illustrates the sample s4 in which two L-shaped heat-sinking plates 30L and 30R are arranged as the heat-sinking part 30 so as to face each other, and corresponds to the coil device 1*a* according to the first embodiment. Furthermore, as for the sample s4 of FIG. 3D, four variations (hereinafter referred to as samples s4*a*, s4*b*, s4*c* and s4*d*) were prepared, for which space Δw between the two L-shaped heat-sinking plates 30L and 30R are respectively set to 5 mm, 10 mm, 15 mm and 20 mm. That is, seven samples s1, s2, s3, s4*a*, s4*b*, s4*c*, and s4*d*, which are classified into four types, were prepared in total. The heat-sinking plates 30*a*, 30*b*, 30L and 30R of the samples s2 to s4 are aluminum plates having a thickness of 1 mm.

Heat Dissipation Performance

First, the coil 4 of the sample s1 having no heat-sinking part 30 as illustrated in FIG. 3A was electrically conducted, and obtained was the amount of the heat generated in the core 2 when a temperature at a position directly above the center leg 3 of the upper face 12 of the core 2 becomes 50° C. (the position is hereinafter referred to as a measurement position P). Then, the samples s1 to s3 and s4*a* to s4*d* were electrically conducted so that the amount of the heat generated in the core 2 of each of the samples s1 to s3 and s4*a* to s4*d* is equal to the foregoing heat amount of the sample s1.

That is, the magnitude of the electric current flowing to the coil 4 of each of the samples s1 to s3 and s4*a* to s4*d* is adjusted so that the heat amounts in the cores 2 of the samples are the same, and in this adjustment, temperature dependency of the heat amount generated in the core 2 when being electrically conducted is considered. As a result, a difference in heat dissipation performance of the heat-sinking part 30 can be compared among the samples s1 to s3 and s4*a* to s4*d*.

Figure 4:
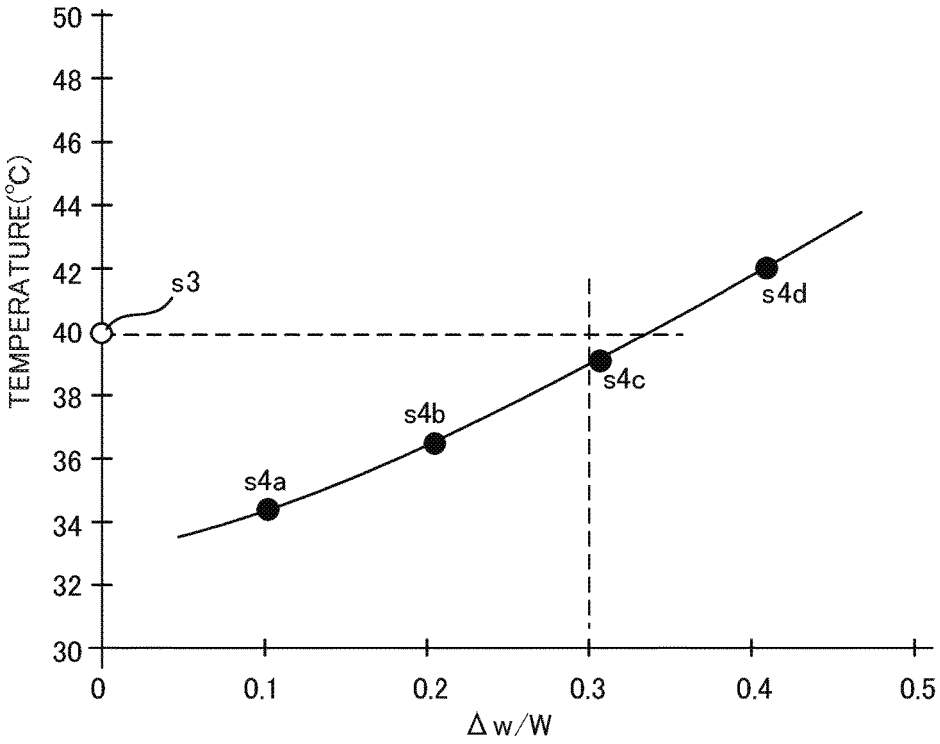
FIG. 4 is a diagram illustrating a relationship between heat dissipation effect and a space between two heat-sinking plates of the coil device according to the first embodiment.

The temperatures at the measurement position P of the samples s1 to s3 and s4*a* to s4*d* were measured as shown in FIGS. 2A, 2B and 4. In any sample s1 to s3 and s4*a* to s4*d*, the temperature at the measurement position P is the maximum temperature.

TABLE 1

| Sample | Heat-sinking plate | Δw | Temperature |
|---|---|---|---|
| s1 | N/A | | 50.0° C. |
| s2 | Only upper face of core | | 46.5° C. |
| s3 | Upper and side faces of core (C-shape) | | 39.9° C. |
| s4a | Upper and side faces of core (L-shape × 2) | 5 mm | 34.4° C. |
| s4b | | 10 mm | 36.5° C. |
| s4c | | 15 mm | 39.1° C. |
| s4d | | 20 mm | 42.0° C. |

As shown in Table 1, it is recognized that the samples s2, s3, and s4*a* to s4*d* including the heat-sinking plates 30*a*, 30*b*, 30L and 30R have more excellent heat dissipation effect than the sample s1 which is the coil device 1 without a heat-sinking part 30. In addition, compared to the sample s2 in which the heat-sinking plate 30*a* is arranged only in the upper face 12 of the core 2, the heat dissipation effect is better in the samples s3, s4*a* to s4*d* in which their own heat-sinking plates 30*b*, 30L and 30R are respectively in contact with the upper faces 12 and the side faces 13L and 13R of their own cores 2.

Among the samples s4*a* to s4*d* including two L-shaped heat-sinking plates 30L and 30R, the samples s4*a* to s4*c* have more excellent heat dissipation effect than that of the sample s3 in which the heat-sinking plate 30*b* is in contact with the entirety of the upper and side faces 12, 13L and 13R of the core 2. This reason can be considered as follow: the heat-sinking plate 30*b* of the sample s3 has a C-shape opened downward and is formed in an integrated manner; and when the core 2 is heated, the core 2 and the heat-sinking plate 30*b* were not able to be thermally deformed in an integrated manner by following their respective deformations. That is, this can be considered that it is because the states of contact between the heat-sinking plate 30*b* and each of the upper and side faces 12, 13L and 13R are not maintained, which impairs thermal conduction efficiency from the core 2 to the heat-sinking plate 30*b*.

Meanwhile, in the sample s4 (including the samples s4*a* to s4*d*), in which two L-shaped heat-sinking plates 30L and 30R are arranged to face each other in the left and right sides of the core 2 with the space Δw, two heat-sinking plates 30L and 30R are able to be follow thermal deformation of the core 2. As a result, the states of contact between the surface of the core 2 and the heat-sinking plates 30L and 30R are maintained. In the samples s4*a* to s4*c* which respectively have the space Δw 5 mm, 10 mm and 15 mm between two heat-sinking plates 30L and 30R, it can be considered as follow: the heat of the core 2 is effectively transferred to the L-shaped heat-sinking plates 30L and 30R, and as a result the heat of the upper face 12 of the core 2 is effectively guided to the heat-sinking board 5; and the heat of the upper and lower core members 2*u* and 2*d* is also effectively discharged to the atmosphere. Furthermore, in the sample s4*d* having a space Δw of 20 mm between two L-shaped heat-sinking plates 30L and 30R, it can be considered as follow: the space Δw is excessively wide, and this impairs the thermal conduction efficiency from the upper face 12 of the core to the heat-sinking plates 30L and 30R; and the heat dissipation effect is degraded relative to the sample s3.

Space Δw of Heat-Sinking Plates

As described above, the heat generated in the core 2 can be effectively dissipated by arranging two L-shaped heat-sinking plates 30L and 30R so as to face each other in the left and right sides of the core 2 with the space Δw. However, if the space Δw is excessively wide, the heat dissipation effect is degraded. Therefore, it is necessary to appropriately determine the space Δw depending on the width W of the core 2. Meanwhile, if data for setting the space Δw exists, it is not necessary to perform a work for optimizing the space Δw whenever the width W of the core 2 is changed depending on the coil device 1*a*. In this regard, a relation between the temperature of the measurement position P and a ratio Δw/W of the space Δw to the width W of the core 2 was investigated. The relation is illustrated in the graph of FIG. 4.

As illustrated in FIG. 4, it is recognized that, if the ratio Δw/W of the space Δw between the two L-shaped heat-sinking plates 30L and 30R to the width W of the core 2 is equal to or lower than "0.3," the heat dissipation effect can be improved better than the sample s3 which includes the C-shaped heat-sinking plate 30*b* having a space Δw of zero (Δw=0). Therefore, if strict temperature control is not needed, it is sufficient that the ratio Δw/W of the space Δw between the two heat-sinking plates 30L and 30R to the width W of the core 2 be set to be equal to or lower than "0.3."

Second Embodiment

Figure 5A:
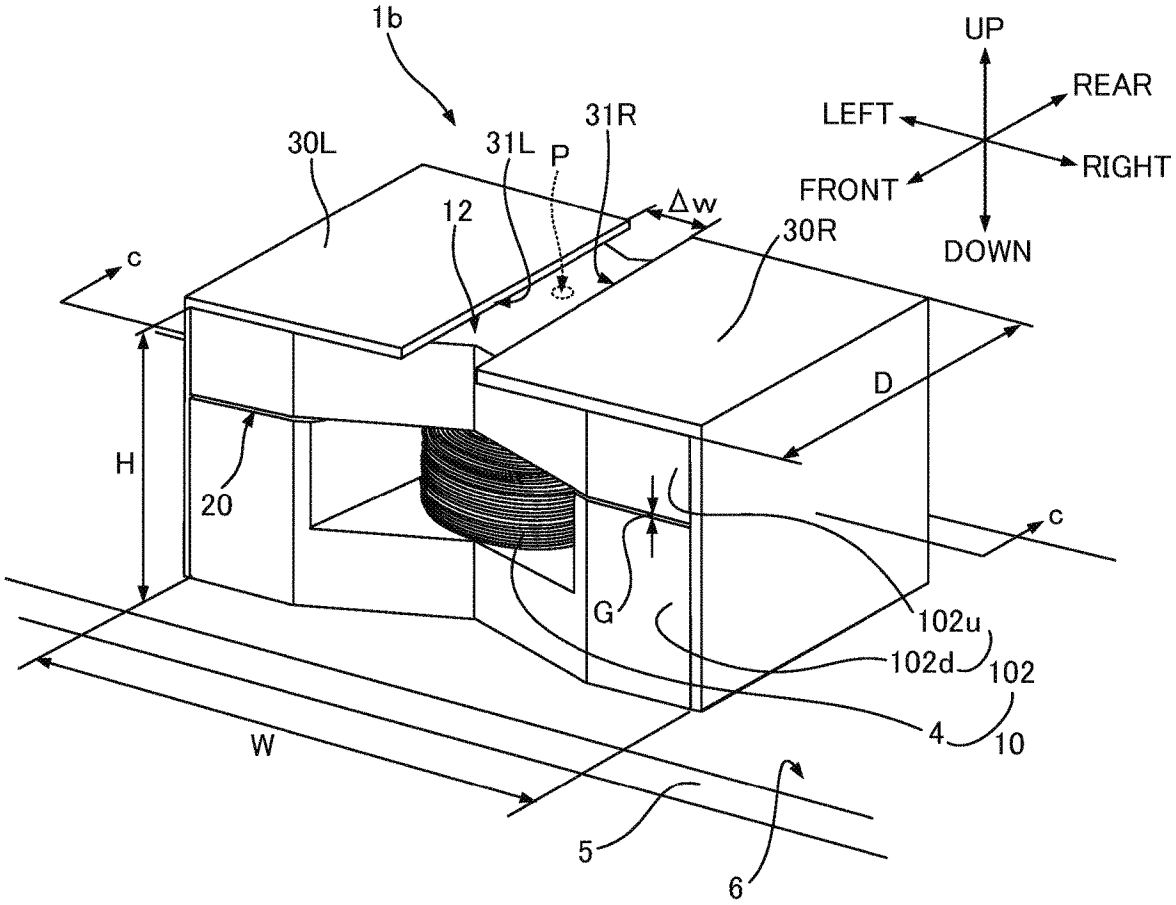
FIG. 5A is a diagram illustrating a coil device according to a second embodiment.
Figure 5B:
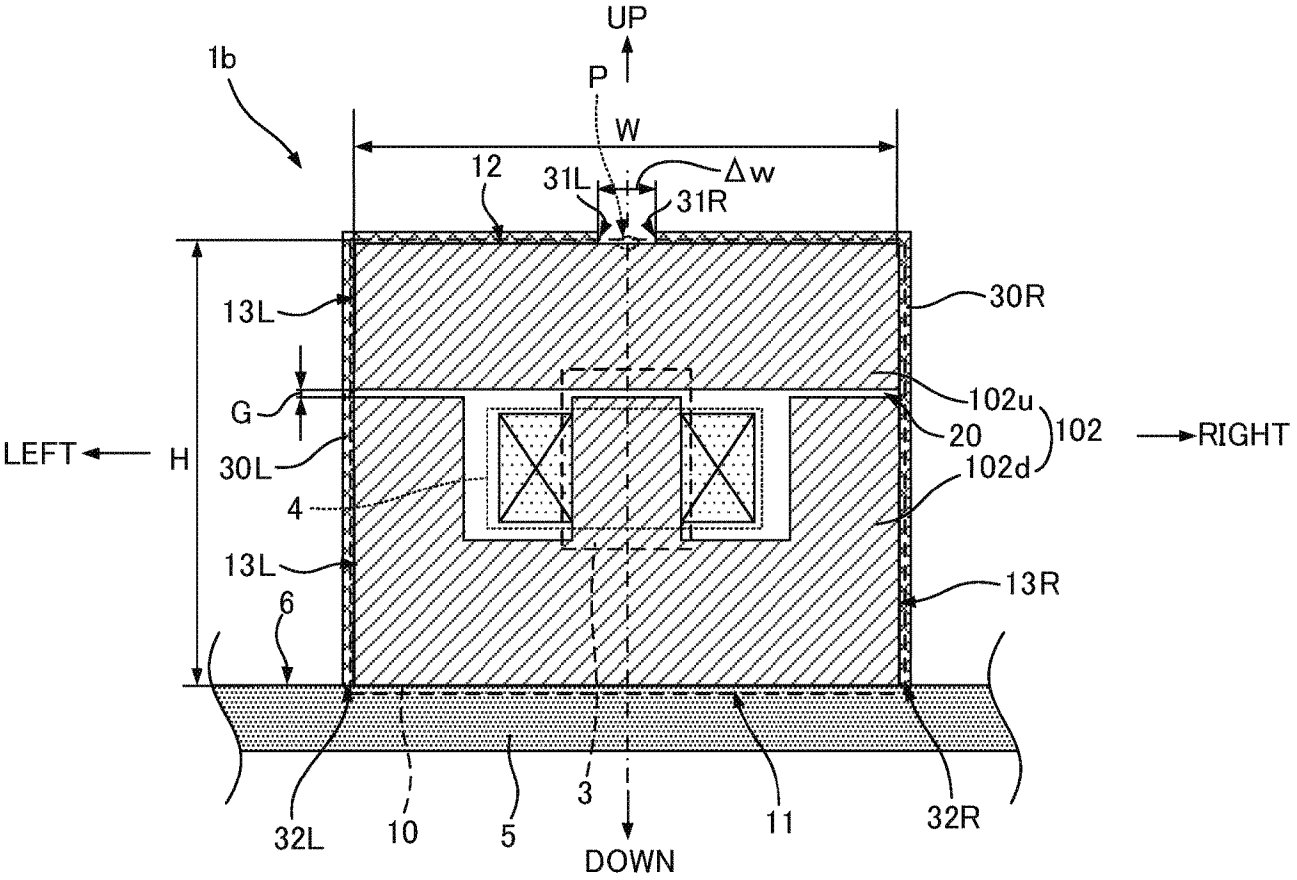
FIG. 5B is a diagram illustrating the coil device according to the second embodiment.

The heat source of the coil device 1*a* is the conducting wire of the coil 4. The heat from the conducting wire is transferred to the center leg 3 of the core 2, so that the temperature of the coil device 1*a* increases. Since in the coil device 1*a* according to the first embodiment the EE-shaped core 2 is used, the center leg 3 is split by the gap 20 in the center of the vertical direction. That is, heat is generated in the conducting wire which is wound in the lower side with respect to the gap 20 in the vertical center of the center leg 3, and the heat is directly transferred from the lower E-shaped core member 2*d* to the heat-sinking board 5 having a large heat capacity. As a result, the heat is effectively dissipated. On the other hand, the heat generated in the conducting wire which is wound in the upper side is transferred from the upper E-shaped core member 2*u* to the heat-sinking plates 30L and 30R. Then, the heat is discharged to the atmosphere or is dissipated through a path from the heat-sinking plates 30L and 30R to the heat-sinking board 5. Therefore, if an EI-shaped core 102 is employed, in which all of the conducting wires of the coil 4 are wound around the center leg 3 in an integrated manner as illustrated in FIG. 5B, a path for directly dissipating the heat from the entire area of the center leg 3 to the heat-sinking board 5 is secured. This makes it possible to obtain a better heat dissipation effect. Thus, in the second embodiment, a coil device 1*b* having an EI-shaped core 102 and two L-shaped heat-sinking plates 30L and 30R is provided. FIGS. 5A and 5B illustrate a schematic structure of the coil device 1*b* according to the second embodiment. FIG. 5A is a perspective view illustrating the coil device 1*b*, and FIG. 5B is a cross-sectional view of FIG. 5A in the direction of view arrows c-c. As illustrated in FIGS. 5A and 5B, the coil device 1*b* according to the second embodiment includes: an EI-shaped core 102 in which an E-shaped core member 102*d* is arranged under an I-shaped core member 102*u*; and a coil 4 in which conducting wires are wound around a center leg 3 of the E-shaped core member 102*d*. Similar to the first embodiment, two L-shaped heat-sinking plates 30L and 30R having the same width in the front-rear direction as the depth D of the core 102 are arranged in the left and right sides of the core 102 to face each other on the upper face 12 of the core 102.

Next, in order to check the heat dissipation property of the coil device 1*b* according to the second embodiment, four types of samples (hereinafter referred to as samples s5*a* to s5*d*) were prepared. The samples s5*a* to s5*d* each include the EI-shaped core 102 and respectively have the space Δw between the two L-shaped heat-sinking plates 30L and 30R to 5 mm, 10 mm, 15 mm, and 20 mm. Then, the temperature at the measurement position P was investigated in the samples s5*a* to s5*d*. As a matter of course, the dimensions and the shape of the coil 4 and the amount of the heat generated in the core 2 are the same values as those of the samples s1, s2, s3 and s4*a* to s4*d* shown in Table 1.

Table 2 shows the temperatures at the measurement positions P in the samples s5*a* to s5*d*.

TABLE 2

| Sample | Heat-sinking plate | Δw | Temperature |
|---|---|---|---|
| s5a | Upper and side faces of core (L-shape × 2) | 5 mm | 27.3° C. |
| s5b | | 10 mm | 29.5° C. |
| s5c | | 15 mm | 32.2° C. |
| s5d | | 20 mm | 34.9° C. |

As shown in Table 2, the temperatures in the samples s5*a* to s5*d* having the EI-shaped core 102 can be lower by approximately 7° C. than the temperatures in the samples s4*a* to s4*d* having the EE-shaped cores 2. Thus, it was recognized that the EI-shape core 102 can have more excellent heat dissipation effect.

Other Embodiments

In the coil devices 1*a* and 1*b* according to the first and second embodiments, the two L-shaped heat-sinking plates 30L and 30R are arranged to face each other with the space Δw. However, the temperatures of the cores 2 and 102 increase/decrease depending on an electric conduction state of the coil 4. And, the cores 2 and 102 thermally expand/contract repeatedly. In particular, the cores 2 and 102 remarkably contract within a short time if the cores 2 and 102 are abruptly cooled.

For this reason, the coil device 1*c* according to the third embodiment is configured so that the state of contact between the heat-sinking part 30 and the core 2 (or 102) can be more reliably maintained.

Figure 6:
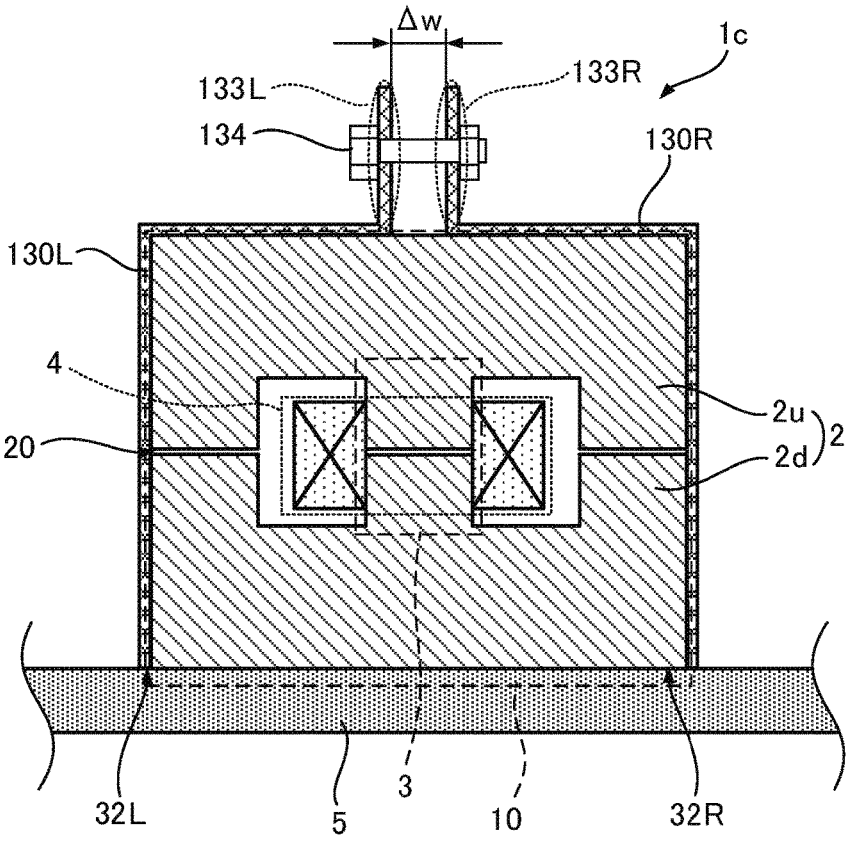
FIG. 6 is a diagram illustrating a coil device according to another embodiment.

In the coil device 1*c* of FIG. 6, two heat-sinking plates 130L and 130R are provided as the heat-sinking part 30, and these plates 130L and 130R are coupled to each other by a fastening member (e.g. a bolt 134) at a predetermined distance.

The heat-sinking plates 130L and 130R have upper end portions 133L and 133R, and the end portions 133L and 133R respectively are formed in a crank shape bent upward from the upper face 12 of the core 2. The heat-sinking plates 130L and 130R are configured so that the end portions 133L and 133R face each other in the left-right direction. In the initial state before the coil 4 is electrically conducted (that is, before heat is generated), the end portions 133L and 133R of the two heat-sinking plates 130L and 130R facing each other are separated by a space Δw and are fixed to each other by a bolt 134 or the like. In the coil device 1*c* having such a structure, even when the core 2 expands and contracts repeatedly, the core 2 thermally expands relative to the foregoing initial state if the coil 4 is electrically conducted. Therefore, the two heat-sinking plates 130L and 130R are biased in such a direction as to approach each other. Further, even when the core 2 is abruptly cooled and remarkably contracts within a short time, the two heat-sinking plates 130L and 130R follow the contraction of the core 2 by virtue of the biasing force. As a result, the states of contact between the core 2 and the heat-sinking plates 130L and 130R can be maintained. Accordingly, the states of contact between the core 2 and the heat-sinking plates 130L and 130R can be more reliably maintained.

As mentioned above, the coil device 1*c* includes means (e.g. the bolt 134) for maintaining constant the space Δw between the two heat-sinking plates 130L and 130R separated in the left and right sides of the core 2. Thus, the coil device 1*c* has a heat dissipation structure capable of coping with irregular expansion and contraction of the core 2.

In the coil devices 1*a* to 1*c* according to the foregoing embodiments, the lower ends 32L and 32R of the heat-sinking plates 30L and 30R (130L and 130R) only are in contact with the heat-sinking board 5. However, if there is extra space in a footprint, the lower ends 32L and 32R of the heat-sinking plates 30L and 30R (130L and 130R) may be fixed to the heat-sinking board 5 by a screw or the like. In any case, it is sufficient that two heat-sinking plates 30L and 30R (130L and 130R) be arranged symmetrically in the left and right sides of the core 2 with the space Δw and that the two heat-sinking plates are in contact with the heat-sinking board 5 and the upper and side faces 12, 13L and 13R of the core 2.

In the samples s1, s2, s3, s4 and s5 prepared in order to check the heat dissipation effect in the first and second embodiments, the heat-sinking plate(s) 30*a* (30*b*; 30L and 30R; 130L and 130R) is placed on the core 2 (102) and is fixed under its own weight. However, in practical use of the coil devices 1*a* to 1*c* according to the first and second embodiments, the heat-sinking plates 30*a*, 30*b*, 30L, 30R, 130L, and 130R may be fixed to the core 2 (102) with adhesive in order to prevent their removal. As a matter of course, in order to prevent hindrance of heat transfer from the core 2 (102) to the heat-sinking plates 30*a*, 30*b*, 30L, 30R, 130L and 130R, it is preferable that the adhesive be applied so as not to be placed between the surface of the core and these heat-sinking plates.

However, for example, a heat-conductive adhesive may be applied between the surface of the core 2 (102) and the heat-sinking plates 30*a*, 30*b*, 30L, 30R, 130L and 130R. In this case, using the adhesive makes it possible easily to more firmly join the heat-sinking plates 30*a*, 30*b*, 30L, 30R, 130L and 130R to the core 2 (102).

As described above, the coil devices 1*a*, 1*b*, and 1*c* according to the foregoing embodiments make it possible to effectively dissipate heat without increasing its footprint. In addition, it is possible to achieve miniaturization and increase of output.

The foregoing embodiments facilitate understanding of the present invention and do not intend to limit the interpretation of the present invention. Variations and modifications may be made in accordance with the spirit and scope of the present invention and equivalents thereof are included in the present invention.

INDUSTRIAL APPLICABILITY

The present invention can be preferably applied to a miniaturized, high-power DC-to-DC converter or the like.

REFERENCE SIGNS LIST

1, 1*a* to 1*c* coil device, s1, s2, s3, s4, s5 coil device (samples)
2, 102 core, 2*u*, 2*d*, 102*u*, 102*d* core member
3 center leg of core, 4 coil, 5 heat-sinking board
10 coil component, 11 lower face
12 upper face, 13 side face, 13L left face, 13R right face
20 gap
30 heat-sinking part, 30*a*, 30*b*, 30L, 30R, 130L, 130R heat-sinking plate
133L end portion, 133R end portion

The invention claimed is:

1. A coil device comprising:
two core members,
at least either one of the two core members being an E-shaped core member,
the E-shaped core member having left and right side faces,
the E-shaped core member having a center leg that extends in a vertical direction;
a conducting wire that is wound around a core,
the core being composed of the two core members that are arranged to face each other in the vertical direction with a gap between the two core members,
the conducting wire being wound around the center leg; and
first and second heat-sinking plates that are composed of metal plates,
the first and second heat-sinking plates being bent so as to be in contact with upper and side faces of the core,
the first and second heat-sinking plates being arranged so that one edges of the first and second heat-sinking plates are placed left-right symmetrically with respect to the core with a space between the edges,
the first and second heat-sinking plates being formed so that another edges of the first and second heat-sinking plates are in contact with a metal heat-sinking board where the core is placed;

wherein a ratio $\Delta Aw/W$ of a space $\Delta w$ between the two heat-sinking plates to a width W of the core in a left-right direction is 0.3 or smaller.

2. The coil device according to claim 1, wherein the core is an El-shaped core including:

the E-shaped core member being the core member arranged in a lower side; and an I-shaped core member being the core member arranged in an upper side.

3. The coil device according to claim 1, the coil device further comprises means for maintaining constant the space between the first and second heat-sinking plates.

* * * * *